US012336606B2

(12) United States Patent
Dobashi

(10) Patent No.: US 12,336,606 B2
(45) Date of Patent: Jun. 24, 2025

(54) ORNAMENT

(71) Applicant: Crossfor Co., Ltd., Kofu (JP)

(72) Inventor: Hidetaka Dobashi, Kofu (JP)

(73) Assignee: Crossfor Co., Ltd., Kofu (JP)

( * ) Notice: Subject to any disclaimer, the term of this patent is extended or adjusted under 35 U.S.C. 154(b) by 0 days.

(21) Appl. No.: 18/570,852

(22) PCT Filed: May 26, 2022

(86) PCT No.: PCT/JP2022/021595

§ 371 (c)(1),
(2) Date: Dec. 15, 2023

(87) PCT Pub. No.: WO2023/135835

PCT Pub. Date: Jul. 20, 2023

(65) Prior Publication Data

US 2024/0277120 A1 Aug. 22, 2024

(30) Foreign Application Priority Data

Jan. 14, 2022 (JP) ..... 2022-004300

(51) Int. Cl.
*A44C 17/02* (2006.01)
*A44C 3/00* (2006.01)
*A44C 7/00* (2006.01)

(52) U.S. Cl.
CPC ..... *A44C 7/00* (2013.01); *A44C 3/008* (2013.01)

(58) Field of Classification Search
CPC ..... A44C 7/00; A44C 17/0275
See application file for complete search history.

(56) References Cited

U.S. PATENT DOCUMENTS 397,433 A * 2/1889 Krug ..... A44C 7/00 63/13
397,434 A * 2/1889 Krug ..... A44C 7/00 63/13

(Continued)

FOREIGN PATENT DOCUMENTS

JP 2009-011535 A 1/2009
JP 2015062491 A 4/2015

(Continued)

OTHER PUBLICATIONS

Office Action issued on Nov. 30, 2023, in corresponding Chinese Application No. 202210802269.6, 9 pages.

(Continued)

*Primary Examiner* — Jack W Lavinder
(74) *Attorney, Agent, or Firm* — Maier & Maier, PLLC

(57) ABSTRACT

A pierced earring that has a simple configuration and that is capable of further emphasizing beauty of its decorative component. A first jump ring of a distance adjustment member is provided. A second jump ring is engaged with the first jump ring. A cross-section of the first jump ring and a cross-section of the second jump ring are each formed in a tapered shape that protrudes at a distal angle of 60° to 90° to an inner side. With this, an inner periphery of the first jump ring and an inner periphery of the second jump ring are linked in point contact to each other. This allows the second jump ring to dangle about a Z-axis, an X-axis, and a Y-axis (three axes) relative to point-link portions in the point contact.

4 Claims, 8 Drawing Sheets

(56) References Cited

U.S. PATENT DOCUMENTS

| | | | | |
|---|---|---|---|---|
| 398,126 | A * | 2/1889 | Brooks | A44C 7/00 63/13 |
| 11,284,688 | B2 * | 3/2022 | Dobashi | A44C 25/001 |

FOREIGN PATENT DOCUMENTS

| | | | |
|---|---|---|---|
| JP | 2018-114258 | A | 7/2018 |
| JP | 6431170 | B1 | 11/2018 |
| KR | 10-1824940 | B1 | 2/2018 |

OTHER PUBLICATIONS

Office Action issued on Apr. 20, 2024, in corresponding Chinese Application No. 202210802269.6, 6 pages.
International Search Report issued on Jun. 28, 2022, in corresponding International application No. PCT/JP2022/021595; 4 pages.
Extended European Search Report issued on Oct. 10, 2024, in corresponding European Application No. 22919290.1, 10 pages.
International Preliminary Report on Patentability issued on Jun. 22, 2023, in corresponding International Application No. PCT/JP2022/021595, 3 pages.

* cited by examiner

VIEW IN DIRECTION A

VIEW IN DIRECTION B

ORNAMENT

TECHNICAL FIELD

The present invention relates to an ornament that is capable of dangling.

BACKGROUND

Pendants (necklaces) and the like in which a gemstone such as a diamond is held with use of a mount portion, and in which the gemstone and the mount portion are arranged to minutely dangle have been known.

When the gemstone held with use of the mount portion minutely dangles, the gemstone looks more sparkling than in a stationary state. Thus, beauty of the gemstone is further emphasized.

For example, a double-ring mechanism in which two coupling portions each including two jump rings engaged with each other are provided on both sides so that a decorative element can dangle with use of a total of the four jump rings.

In such a double-ring mechanism that is employed in the pendant and the like in the related art, since the coupling portions are present respectively on the right and the left, the decorative member dangles about a single imaginary-rotation axis.

SUMMARY

Incidentally, in the field of accessories to be fixed to an earlobe, such as pierced earrings, there has been a request for emphasized beauty of their decorative components.

In addition, there has been another request for simplifying the dangling mechanism.

Not only the pierced earrings but also other ornaments such as the necklaces have faced such requests.

The present invention has been made to achieve an object to provide an ornament that has a simple configuration and is capable of further emphasizing beauty of its decorative component.

In order to solve the problems as described above in the related art, and to achieve the above-mentioned object, according to the present invention, there is provided an ornament including:

- a fixing portion to be fixed to a portion for fixation;
- a first engaging portion
  - that is fixed directly or indirectly to the fixing portion, and
  - that includes a first curved portion which is formed in a circular shape or a circular-arc shape; and
- a second engaging portion
  - that includes a second curved portion
    - which is formed in a circular shape or a circular-arc shape, and
    - which allows an inner peripheral portion of the first curved portion and an inner peripheral portion of the second curved portion to be linked to each other, and
  - that is engaged with the first engaging portion in a manner that allows the second engaging portion to dangle,
- a link portion of the first curved portion and a link portion of the second curved portion each being formed in a tapered shape that protrudes at a distal angle of 60° to 90° to an inner side.

It is preferred that the second engaging portion be configured to be capable of dangling about three axes that are orthogonal or substantially orthogonal to each other relative to the first engaging portion and relative to the link portions in point contact.

It is preferred that a decorative element be fixed to or formed integrally with the second engaging portion.

It is preferred

- that the portion for the fixation be an earlobe, and
- that a distance between a position at which the ear is subjected to the fixation with use of the fixing portion and the link portions be 4 mm or more.

It is preferred that the ornament further include

- a distance adjustment member having
  - one end at which the fixing portion is located, and
  - another end at which the first engaging portion is located.

It is preferred that the distal angle of the second curved portion be lower than the distal angle of the first curved portion.

It is preferred that the first engaging portion and the second engaging portion each be a jump ring.

It is preferred that an inner diameter of the first engaging portion and an inner diameter of the second engaging portion each be 0.80 mm to 1.50 mm.

It is preferred that an outer diameter of the first engaging portion and an outer diameter of the second engaging portion each be 1.40 mm to 2.00 mm.

It is preferred that a width of the first engaging portion and a width of the second engaging portion each be 0.20 mm to 0.50 mm.

It is preferred that the inner diameter of the second engaging portion be smaller than the inner diameter of the first engaging portion.

It is preferred that the portion for the fixation be a string-like member of a necklace.

According to the present invention, there is provided another ornament including:

- a fixing portion to be fixed to a member for fixation;
- a first jump ring
  - that is fixed directly or indirectly to the fixing portion; and
- a second jump ring
  - that allows an inner peripheral portion of the first jump ring and an inner peripheral portion of the second jump ring to be linked to each other, and
  - that is engaged with the first jump ring in a manner that allows the second jump ring to dangle,
- a link portion of the first jump ring and a link portion of the second jump ring each being formed in a tapered shape that protrudes at a distal angle of 60° to 90° to an inner side,
- the second jump ring being configured to be capable of dangling about three axes that are orthogonal or substantially orthogonal to each other relative to the first jump ring and relative to the link portions in point contact,
- a distance between a position at which an ear is subjected to the fixation with use of the fixing portion and the link portions being 4 mm or more,
- an inner diameter of the first jump ring and an inner diameter of the second jump ring each being 0.80 mm to 1.50 mm,
- an outer diameter of the first jump ring and an outer diameter of the second jump ring each being 1.40 mm to 2.00 mm, a width of the first jump ring and a width of the second jump ring each being 0.20 mm to 0.50 mm.

In addition, according to the present invention, there is provided a still another ornament including:

a fixing portion to be fixed to an ear;

a first jump ring that is fixed directly or indirectly to the fixing portion; and a second jump ring that allows an inner peripheral portion of the first jump ring and an inner peripheral portion of the second jump ring to be linked to each other, and that is engaged with the first jump ring in a manner that allows the second jump ring to dangle, a link portion of the first jump ring and a link portion of the second jump ring each being formed in a substantially fan-like tapered shape that protrudes at a distal angle of 60° to 90° to an inner side in cross-section, the second jump ring being configured to be capable of dangling about three axes that are orthogonal or substantially orthogonal to each other relative to the first jump ring and relative to the link portions in point contact, a distance between a position at which the ear is subjected to the fixation with use of the fixing portion and the link portions being 4 mm or more, an inner diameter of the first jump ring and an inner diameter of the second jump ring each being 0.80 mm to 1.50 mm, an outer diameter of the first jump ring and an outer diameter of the second jump ring each being 1.40 mm to 2.00 mm, a width of the first jump ring and a width of the second jump ring each being 0.20 mm to 0.50 mm.

Advantageous Effects of Invention

According to the present invention, it is possible to provide an ornament that is capable of further emphasizing beauty of its decorative component.

DETAILED DESCRIPTION OF EMBODIMENTS

Below, a pierced earring according to an embodiment of an ornament of the present invention is described with reference to the drawings.

Figure 1:
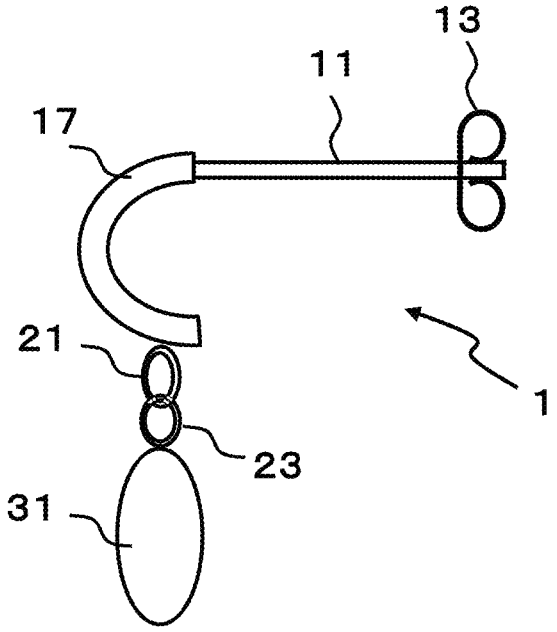
FIG. 1 is an overall exterior view of a pierced earring according to an embodiment of the present invention.

FIG. 1 is an overall exterior view of a pierced earring 1 according to the embodiment of the present invention.

Figure 2:
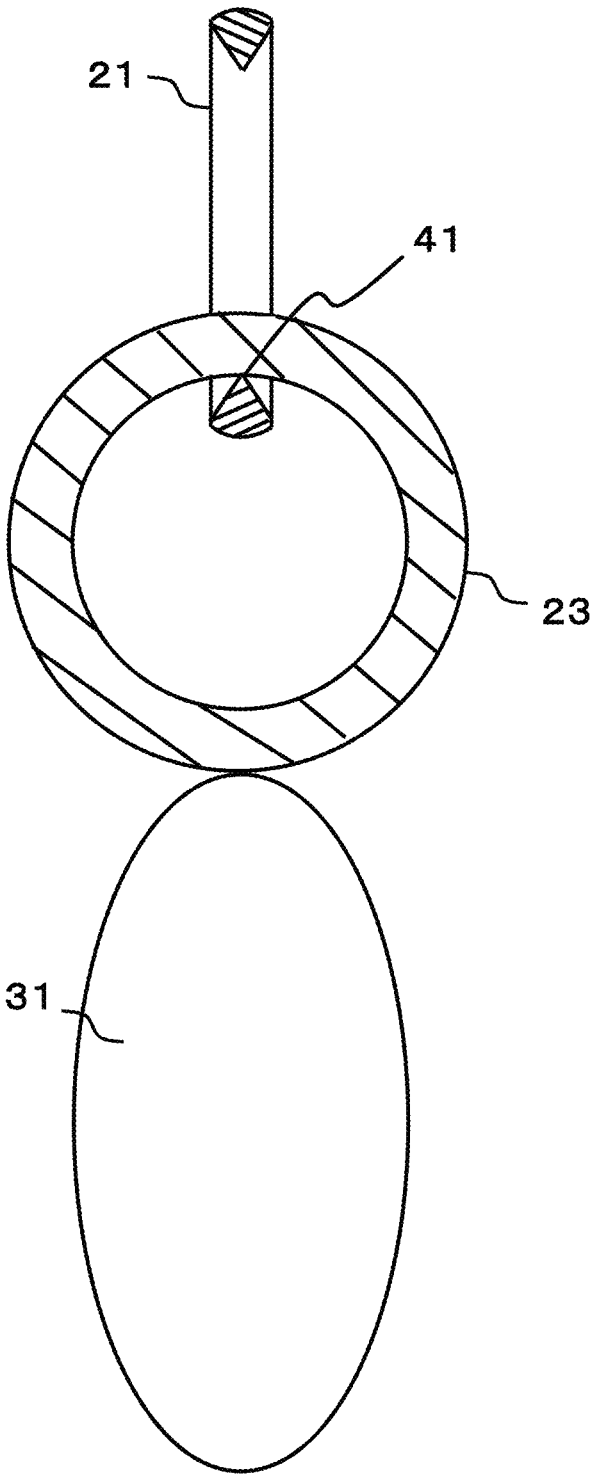
FIG. 2 is an enlarged cross-sectional view of a part including a first jump ring 21*m* a second jump ring 23, and a decorative element 31 of the pierced earring illustrated in FIG. 1.

FIG. 2 is an enlarged cross-sectional view of a part including a first jump ring 21, a second jump ring 23, and a decorative element 31 of the pierced earring 1 illustrated in FIG. 1.

As illustrated in FIG. 1, the pierced earring 1 includes a post 11 and a fixing portion 13. The fixing portion 13 is provided at one end of the post 11, and is fixed (fitted) to an earlobe.

One end of a distance adjustment member 17 is provided at another end of the post 11.

The first jump ring 21 is provided (fixed) to another end of the distance adjustment member 17.

A second jump ring 23 is engaged with the first jump ring 21 in a manner that allows the second jump ring 23 to dangle.

A cross-section of a distal end of the first jump ring 21 and a cross-section of a distal end of the second jump ring 23 are each formed in a tapered shape that protrudes at a distal angle of 60° to 90° to an inner side (center of circumference).

With this, an inner periphery of the first jump ring 21 and an inner periphery of the second jump ring 23 are linked in point contact to each other, which allows the second jump ring 23 to dangle about three axes that are orthogonal or substantially orthogonal to each other relative to point-link portions 41 of the point contact.

The decorative element 31 is fixed to the second jump ring 23. The decorative element 31 is an object that performs a decorative function, such as a gemstone.

Figure 3:
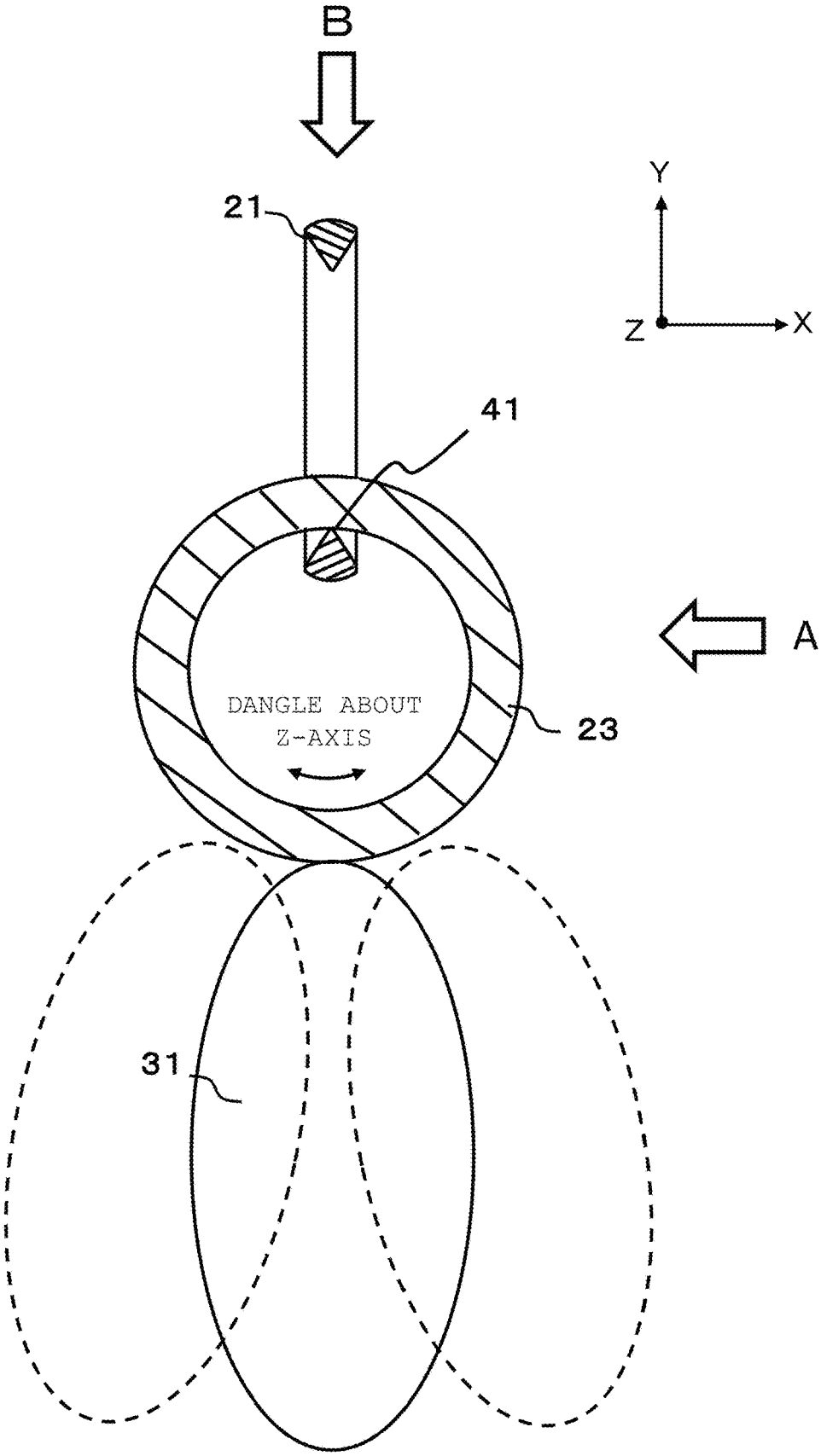
FIG. 3 is an explanatory view illustrating how the second jump ring of the pierced earring according to the embodiment of the present invention dangles about a Z-axis.

FIG. 3 is an explanatory view illustrating how the second jump ring 23 of the pierced earring 1 according to the embodiment of the present invention dangles about a Z-axis.

Figure 4:
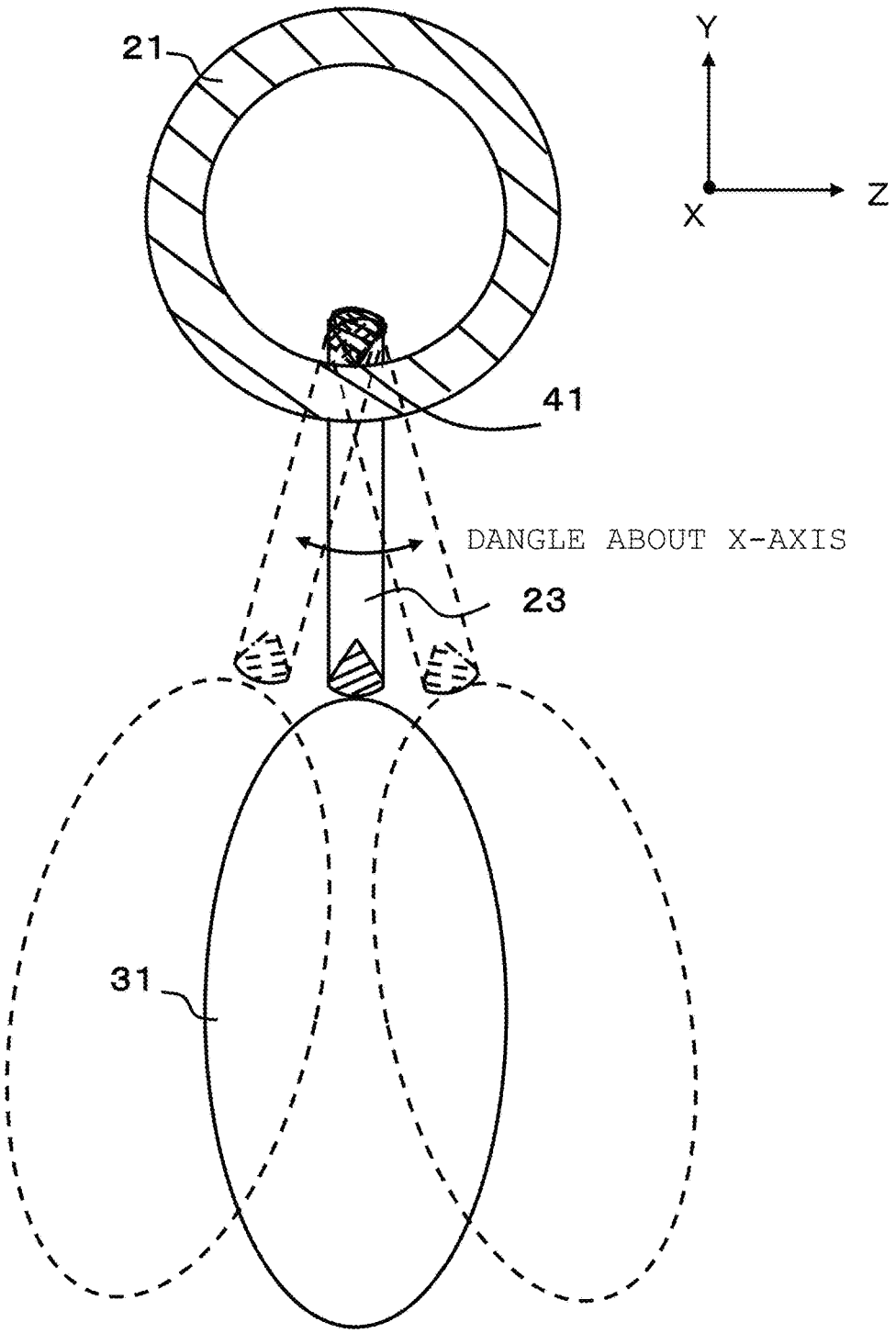
FIG. 4 is an explanatory view illustrating how the second jump ring of the pierced earring according to the embodiment of the present invention dangles about an X-axis.

FIG. 4 is an explanatory view illustrating how the second jump ring 23 of the pierced earring 1 according to the embodiment of the present invention dangles about an X-axis.

Figure 5:
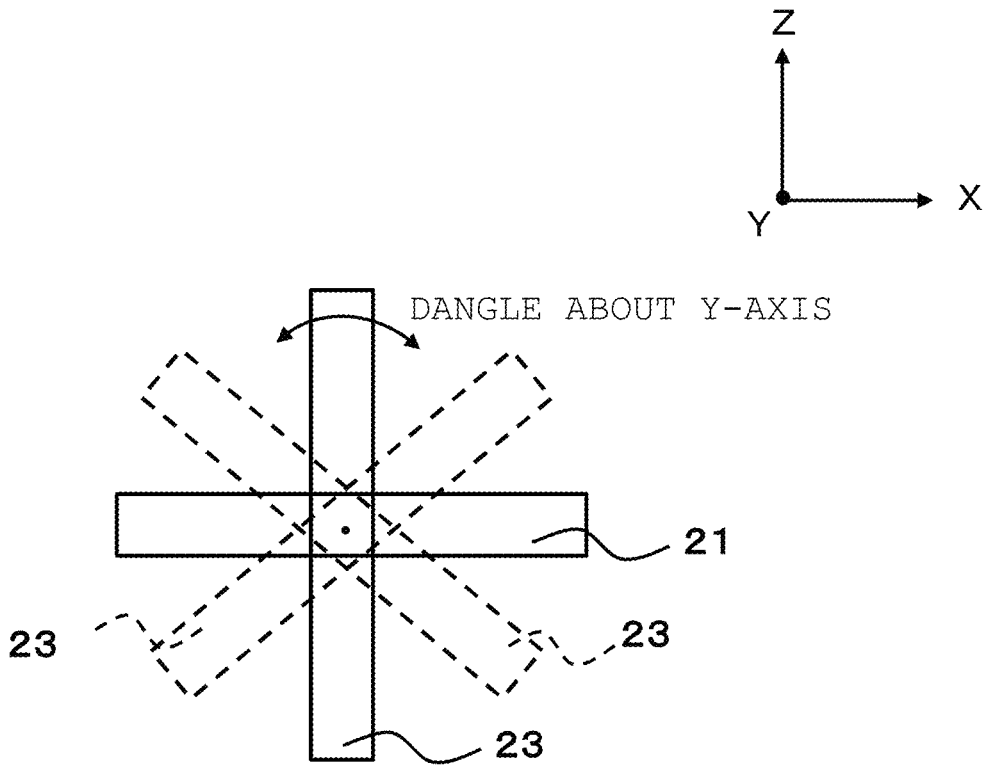
FIG. 5 is an explanatory view illustrating how the second jump ring of the pierced earring according to the embodiment of the present invention dangles about a Y-axis.

FIG. 5 is an explanatory view illustrating how the second jump ring 23 of the pierced earring 1 according to the embodiment of the present invention dangles about a Y-axis.

The first jump ring 21 and the second jump ring 23 are point-linked to each other at the point-link portions 41 at the distal ends of the inner peripheries of both the rings. Thus, as illustrated in FIG. 3 to FIG. 5, in conjunction with motions of a user with the fixing portion 13 of the pierced earring 1 fitted to his/her earlobe, the second jump ring 23 dangles about the Z-axis, the X-axis, and the Y-axis (three axes) that are orthogonal or substantially orthogonal to each other about the point-link portions 41 of the point contact. When the second jump ring 23 dangles simultaneously about the Z-axis, the X-axis, and the Y-axis (three axes), the second jump ring 23 can dangle in more diverse and unpredictable ways than those in a case where the second jump ring 23 dangles about one axis. With this, an aesthetic appearance to be exhibited by the dangling is more emphasized than that of the pendant having the double-ring mechanism described in "Background Art."

Figure 6:
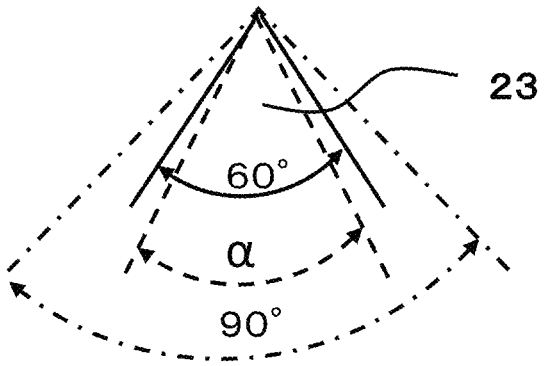
FIG. 6 is an explanatory view illustrating a distal angle α in cross-sections of the first jump ring and the second jump ring.

FIG. 6 is an explanatory view illustrating a distal angle α in the cross-sections of the first jump ring 21 and the second jump ring 23.

In this embodiment, an inner diameter of the first jump ring 21 and an inner diameter of the second jump ring 23 are each 0.80 mm to 1.50 mm.

Further, an outer diameter of the first jump ring 21 and an outer diameter of the second jump ring 23 are each 1.40 mm to 2.00 mm.

Still further, a width of the first jump ring 21 and a width of the second jump ring 23 are each 0.20 mm to 0.50 mm.

In such shapes of the first jump ring 21 and the second jump ring 23, the distal angle $\alpha$ in the cross-sections of the first jump ring 21 and the second jump ring 23 is set to 60° to 90°. With this, even when the second jump ring 23 dangles with the pierced earring 1 put on an ear, the second jump ring 23 does not hit against the inner periphery of the first jump ring 21 out of the point-link portions 41. As a result, the second jump ring 23 dangles over a long period of time.

Figure 7:
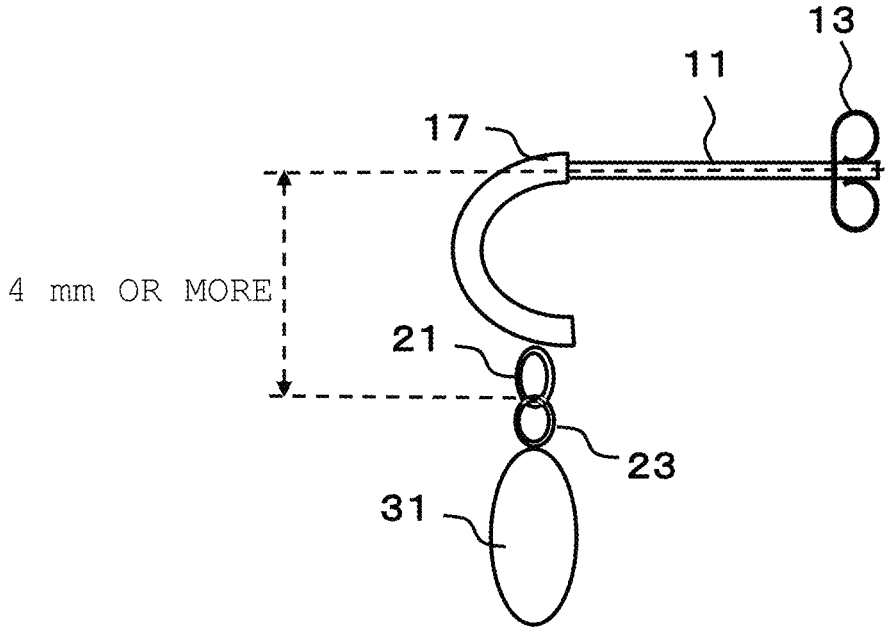
FIG. 7 is an explanatory view illustrating a distance between a post and point-link portions in the pierced earring according to the embodiment.

FIG. 7 is an explanatory view illustrating a distance between the post 11 and the point-link portions 41 in the pierced earring 1 according to this embodiment.

In the above-described sizes of the first jump ring 21 and the second jump ring 23, a distance between a position at which the earlobe is subjected to the fixation with use of the fixing portion 13 and the point-link portions 41 is set to 4 mm or more. With this, the second jump ring 23 can avoid hitting against the ear while dangling.

As described above, in the pierced earring 1, the cross-section of the first jump ring 21 and the cross-section of the second jump ring 23 are each formed in the tapered shape that protrudes at the distal angle of 60° to 90° to the inner side (center of circumference). With this, the inner periphery of the first jump ring 21 and the inner periphery of the second jump ring 23 are linked to each other at a point, that is, at the point-link portions 41. Thus, the second jump ring 23 and the decorative element 31 dangle about the Z-axis, the X-axis, and the Y-axis (three axes) relative to the point-link portions 41. This allows a dangling pattern to be more diversified than that of the pendant having the double-ring mechanism described in "Background Art."

Further, in the pierced earring 1, a simple dangling mechanism of can be obtained by engaging the first jump ring 21 and the second jump ring 23 with each other.

Still further, in the pierced earring 1, as described above, the first jump ring 21 and the second jump ring 23 are sized such that the second jump ring 23 can dangle over a long period of time without hitting against the inner periphery of the first jump ring 21 out of the point-link portions 41.

The link portions of a first curved portion of the first jump ring 21 and a second curved portion of the second jump ring 23 each have the substantially fan-like tapered shape that protrudes at the distal angle of 60° to 90° to the inner side in cross-section. With this, even when the first jump ring 21 and the second jump ring 23 relatively widely dangle, their inner peripheral portions do not come into contact with each other. This allows the first jump ring 21 and the second jump ring 23 to dangle over a long period of time.

In other words, if the distal angle of any one of the inner peripheral portions is more than 90°, the inner peripheral portions are liable to come into contact with each other by the dangling.

In addition, the first jump ring 21 and the second jump ring 23 come below the earlobe of the user. With this, the first jump ring and the second jump ring can avoid being suppressed from dangling by coming into contact with the earlobe.

Yet further, in the pierced earring 1, the distance between the position at which the earlobe is subjected to the fixation with use of the fixing portion 13 and the point-link portions 41 is set to 4 mm or more. With this, the second jump ring 23 can avoid hitting against the ear while dangling.

Note that, the present invention is not limited to the examples described above in the embodiment of the present invention or to its application examples.

For example, the ornament of the present invention need not necessarily be the pierced earring, and may be a non-pierced earring.

For example, a first engaging portion and a second engaging portion of the present invention need not necessarily be the first jump ring 21 and the second jump ring 23 as in the example of the above-described embodiment of the present invention. An at least one of the engaging portions may be formed in a shape other than that of the jump rings as long as the at least one of the engaging portions includes a curved portion having a circular shape or a circular-arc shape.

Further, the distance between the position at which the earlobe is subjected to the fixation with use of the fixing portion 13 and the point-link portions 41 need not necessarily be set to 4 mm or more as in the exemplary case of the above-described embodiment of the present invention. The distance may be less than 4 mm, or the distance adjustment member 17 may be omitted.

Still further, the distal angle of each of the first jump ring 21 and the second jump ring 23 is not limited in particular as long as this distal angle falls within the range of 60° to 90°.

Yet further, the distal angle of the inner periphery of the second jump ring 23 may be set to be lower than the distal angle of the inner periphery of the first jump ring 21. Such a setting allows the second jump ring 23 to further widely dangle while strength of the first jump ring 21 is maintained.

Yet further, the inner diameter of the second jump ring 23 may be set to be smaller than the inner diameter of the first jump ring 21. Such a setting allows the decorative element 31 to be further eye-catching while a dangling function is maintained.

The present invention need not necessarily be applied to a non-pierced earring as in the exemplary case of the above-described embodiment of the present invention. The present invention may be applied, for example, to a necklace.

Figure 8:
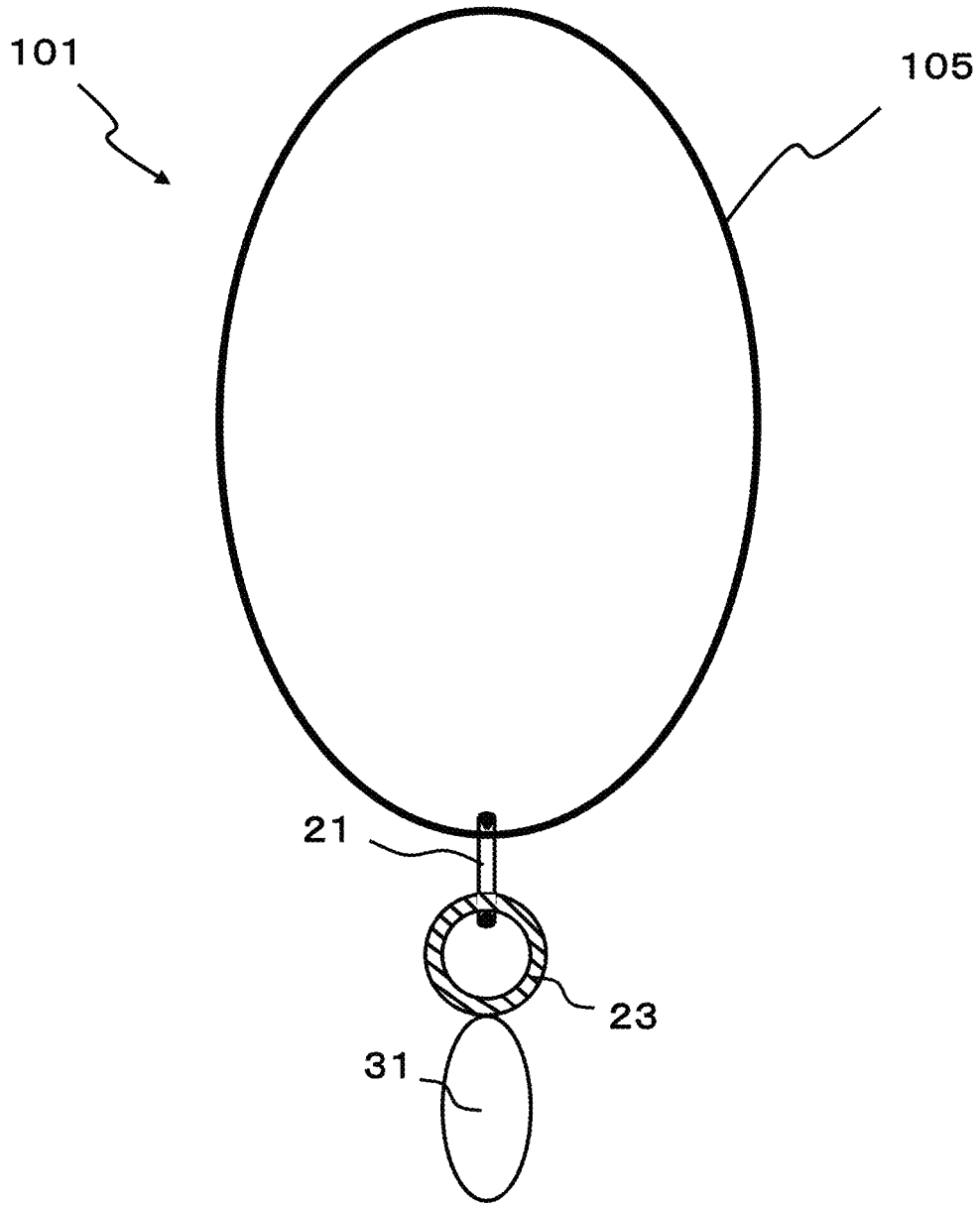
FIG. 8 is an explanatory view of a necklace according to another embodiment of the present invention.

FIG. 8 is an explanatory view of a necklace according to another embodiment of the present invention.

As illustrated in FIG. 8, a necklace 101 includes a string-like member 105 to which the first jump ring 21 described with reference to FIG. 2 is fixed. The second jump ring 23 is engaged with the first jump ring 21 with the first jump ring 21 in the manner that allows the second jump ring 23 to dangle.

The cross-section of the distal end of the first jump ring 21 and the cross-section of the distal end of the second jump ring 23 are each formed in the fan-like tapered shape that protrudes at the distal angle of 60° to 90° to the inner side (center of circumference) in cross-section.

With this, the inner periphery of the first jump ring 21 and the inner periphery of the second jump ring 23 are linked in point contact to each other. This allows the second jump ring 23 to dangle about the three axes that are orthogonal or substantially orthogonal to each other relative to the point-link portions 41 in the point contact.

The decorative element 31 is fixed to the second jump ring 23. The decorative element 31 is an object that performs the decorative function, such as a gemstone.

As illustrated in FIG. 8, also in the necklace 101, the cross-section of the first jump ring 21 and the cross-section of the second jump ring 23 are each formed in the tapered shape that protrudes at the distal angle of 60° to 90° to the inner side (center of circumference). With this, the inner periphery of the first jump ring 21 and the inner periphery of the second jump ring 23 are linked to each other at a point, that is, at the point-link portions 41. Thus, the second jump ring 23 and the decorative element 31 dangle about the Z-axis, the X-axis, and the Y-axis (three axes) relative to the point-link portions 41. This allows a dangling pattern to be more diversified than that of the pendant having the double-ring mechanism described in "Background Art."

Further, in the necklace 101, a simple dangling mechanism can be obtained by engaging the first jump ring 21 and the second jump ring 23 with each other.

Still further, components to be added as appropriate by persons skilled in the art to the above-described embodiments or to its application examples, components to be removed as appropriate by the persons from the above-described embodiments or from its application examples, design modification to be made as appropriate by the persons to the components, or combinations of features of the embodiments to be made as appropriate by the persons are also encompassed within the scope of the present invention as long as the gist of the present invention is not impaired.

The invention claimed is:

1. An ornament, comprising:

a fixing portion configured to be fixed to an ear;

a first jump ring that is fixed, directly or indirectly, to the fixing portion; and a second jump ring that allows an inner peripheral portion of the first jump ring and an inner peripheral portion of the second jump ring to be linked to each other, and that is engaged with the first jump ring in a manner that allows the second jump ring to dangle, a link portion of the first jump ring and a link portion of the second jump ring each being formed in a substantially tapered shape that protrudes at a distal angle of 60° to 90° to an inner side in cross-section, a distal angle of the second jump ring is smaller than a distal angle of the first jump ring, the second jump ring being configured to be capable of dangling about three axes that are orthogonal or substantially orthogonal to each other relative to the first jump ring and relative to the link portion of the first jump ring and the link portion of the second jump ring in point contact, a distance between a position at which the ear is subjected to fixation with use of the fixing portion and the link portion of the first jump ring and the link portion of the second jump ring is 4 mm or more, an inner diameter of the first jump ring and an inner diameter of the second jump ring each being 0.80 mm to 1.50 mm, an outer diameter of the first jump ring and an outer diameter of the second jump ring each being 1.40 mm to 2.00 mm, a width of the first jump ring and a width of the second jump ring each being 0.20 mm to 0.50 mm.

2. The ornament according to claim 1, wherein a decorative element is fixed to, or formed integrally with, the second jump ring.

3. The ornament according to claim 1, further comprising a distance adjustment member having one end at which the fixing portion is located, and another end at which the first jump ring is located.

4. The ornament according to claim 1, wherein the inner diameter of the second jump ring is smaller than the inner diameter of the first jump ring.

* * * * *